US005403360A

United States Patent [19]

Sütterlin et al.

[11] Patent Number: 5,403,360

[45] Date of Patent: Apr. 4, 1995

[54] PROCESS FOR DYEING OR PRINTING CELLULOSIC FIBER MATERIALS

[75] Inventors: Wolfgang Sütterlin, Lörrach, Germany; Rolf Bitterli, Himmerlried; Paul Schafflützel, Basel, both of Switzerland

[73] Assignee: Ciba-Geigy Corporation, Ardsley, N.Y.

[21] Appl. No.: 189,616

[22] Filed: Feb. 1, 1994

[30] Foreign Application Priority Data

Feb. 5, 1993 [CH] Switzerland ..... 358/93

[51] Int. Cl.[6] ..... C09B 62/04; D06P 3/66

[52] U.S. Cl. ..... 8/549; 8/918; 8/921; 8/618

[58] Field of Search ..... 8/549, 918, 921, 618, 8/543

[56] References Cited

U.S. PATENT DOCUMENTS 4,391,607 7/1983 Hildebrand ..... 8/549
4,659,333 4/1987 Sehaub ..... 8/476
4,826,503 5/1989 Land ..... 8/543
5,106,388 4/1992 Sütterlin et al. ..... 8/477

FOREIGN PATENT DOCUMENTS 044463 1/1982 European Pat. Off. .

OTHER PUBLICATIONS

Chem. Absts. 97(16) 129074j (1982 no month available).
Chem. Absts. 88(10) 137845r (1978 no month available).
G. Gongyi et al. American Dye Stuff Reporter vol. 81 (1992) pp. 180–186.

*Primary Examiner*—Paul Lieberman
*Assistant Examiner*—Margaret Einsmann
*Attorney, Agent, or Firm*—George R. Dohmann

[57] ABSTRACT

A process for dyeing or printing cellulosic fibre material with reactive dyes, which comprises dyeing or printing said material with at least one reactive dye that contains a chlorotriazinyl radical, and washing off the dyeing or print so obtained with an aqueous solution to which at least 0.01 gram per liter of an alkaline earth metal salt has been added. Dyeings and prints of good fastness properties are obtained.

7 Claims, No Drawings

PROCESS FOR DYEING OR PRINTING CELLULOSIC FIBER MATERIALS

The present invention relates to a novel process for dyeing or printing cellulosic fibre materials with reactive dyes that contain chlorotriazinyl radicals, wherein the dyeings or prints obtained are washed off with an aqueous solution to which alkaline earth metal salts have been added.

Processes for dyeing or printing cellulosic fibre materials with reactive dyes have long been known. The prior art processes, however, are not in all respects able to meet the requirements of practice made of the resultant dyeings or prints, for example as regards fastness properties, especially wetfastness properties.

It has now been found that the process described hereinafter meets these requirements.

Accordingly, the invention relates to a process for dyeing or printing cellulosic fibre material with reactive dyes, which comprises dyeing or printing said material with at least one reactive dye that contains a chlorotriazinyl radical, and washing off the dyeing or print so obtained with an aqueous solution to which at least 0.0 1 gram per liter of an alkaline earth metal salt has been added.

The reactive dyes are preferably derived from the radical of a monoazo, polyazo, metal complex azo, anthraquinone, phthalocyanine, formazan, azomethine, dioxazine, phenazine, stilbene, triphenylmethane, xanthene, thioxanthone, nitroaryl, naphthoquinone, pyrenequinone or perylenetetracarbimide dye, preferably the radical of a monoazo, disazo, metal complex azo, anthraquinone or phthalocyanine dye.

In addition to containing the reactive group, the reactive dyes may contain in the molecule, as further substituents, the customary substituents of organic dyes.

Illustrative examples of such further substituents of reactive dyes are: alkyl groups of 1 to 4 carbon atoms, typically methyl, ethyl, propyl, isopropyl or butyl, alkoxy groups of 1 to 4 carbon atoms such as methoxy, ethoxy, propoxy, isopropoxy or butoxy; acylamino groups containing 1 to 8 carbon atoms, preferably alkanoylamino groups and alkoxycarbonylamino groups, including acetylamino, propionylamino, methoxycarbonylamino, ethoxycarbonylamino or benzoylamino, phenylamino, N-N-di-$\beta$-hydroxyethylamino, N,N-di-$\beta$-sulfatoethylamino, sulfobenzylamino, N,N-disulfobenzylamino; phenyl; alkoxycarbonyl containing 1 to 4 carbon atoms in the alkoxy moiety, typically methoxycarbonyl or ethoxycarbonyl; alkylsulfonyl of 1 to 4 carbon atoms such as methylsulfonyl or ethylsulfonyl; trifluormethyl; nitro; cyano; halogen such as fluoro, chloro or bromo; carbamoyl, N-alkylcarbamoyl containing 1 to 4 carbon atoms in the alkyl moiety, typically N-methylcarbamoyl or N-ethylcarbamoyl; sulfamoyl, N-alkylsulfamoyl containing 1 to 4 carbon atoms, including N-methylsulfamoyl, N-ethylsulfamoyl, N-propylsulfamoyl, N-isopropylsulfamoyl or N-butylsulfamoyl, N-($\beta$-hydroxyethyl)sulfamoyl, N,N-di-($\beta$-hydroxyethyl)sulfamoyl, N-phenylsulfamoyl; ureido, hydroxy, carboxy, amino, sulfomethyl or sulfo. The phenyl radicals may typically be further substituted by $C_1$–$C_4$alkyl, $C_1$–$C_4$alkoxy, halogen or sulfo. The reactive dyes preferably contain one or more than one sulfonic acid group.

Preferred substituents are $C_1$–$C_4$alkyl, $C_1$–$C_4$alkoxy, halogen, amino, hydroxy, ureido, methylsulfonyl, sulfo, phenyl, phenylamino, sulfamoyl, N-alkylsulfamoyl containing 1 to 4 carbon atoms and N-phenylsulfamoyl, the phenyl moieties of which substituents may typically be further substituted by $C_1$–$C_4$alkyl, $C_1$–$C_4$alkoxy, halogen or sulfo.

The reactive dyes are preferably derived from the following dyes:

a) Radicals of a 1:1 copper complex azo dye of formula

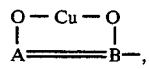

(1)

wherein A and B are each independently of the other a radical of the benzene or naphthalene series and the radicals —O— on both sides are in orthoposition to the azo bridge. In connection with possible substituents of the radicals A and B, the definitions and preferences stated above apply. Such substituents are preferably $C_1$–$C_4$alkyl, $C_1$–$C_4$alkoxy, halogen, amino, hydroxy or sulfo. Sulfo is especially preferred.

b) Radicals of a mono- or disazo dye of formula $$D_1—N=N—(M—N=N)_u—K— \quad (2a) \text{ or}$$

$$—D_1—N=N—(M—N=N)_u—K \quad (2b),$$

wherein $D_1$ is the radical of a diazo component of the benzene or naphthalene series, M is the radical of a middle component of the benzene or naphthalene series, and K is the radical of a coupling component of the benzene, naphthalene, 6-hydroxypyrid-2-one or pyrazolone series, and u is 0 or 1. In connection with possible substituents of the radicals $D_1$, M und K, the definitions and preferences stated above apply. Such substituents are preferably $C_1$–$C_4$alkyl, $C_1$–$C_4$alkoxy, halogen, amino, hydroxy, ureido, methylsulfonyl, sulfo or phenyl. Phenyl may typically be further substituted by $C_1$–$C_4$alkyl, $C_1$–$C_4$alkoxy, halogen or sulfo.

c) Radicals of an anthraquinone dye of formula

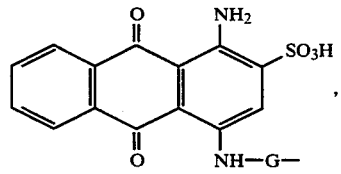

(3)

wherein G is a phenylene radical which is unsubstituted or substituted by $C_1$–$C_4$alkyl, $C_1$–$C_4$alkoxy, halogen or sulfo.

d) Radicals of a phthalocyanine dye of formula

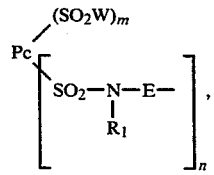

(4)

wherein Pc is the radical of a copper phthalocyanine, W is hydroxyl or amino, $R_1$ is hydrogen or $C_1$–$C_4$alkyl, E is a phenylene radical which is unsubstituted or substituted by $C_1$–$C_4$alkyl, halogen or sulfo, or is a $C_2$–$C_6$alkylene radical, preferably a sulfophenylene or ethylene radical, m is 2 to 3 and n is 1 to 2.

Suitable chlorotriazinyl reactive radicals are preferably those of formula

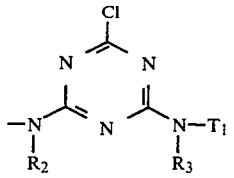

(5)

wherein $R_2$ and $R_3$ are each independently of the other hydrogen or $C_1$–$C_4$alkyl, and $T_1$ is hydrogen; phenyl or phenyl which is substituted by $C_1$–$C_4$alkyl, halogen or sulfo, preferably by sulfo; or $C_1$–$C_6$alkyl which may be interrupted by —O— and further substituted by hydroxyl. A further possible substituent of the phenyl radical is 1-amino-2-sulfoanthraquinon-4-yl.

Preferably $T_1$ is hydrogen; phenyl or sulfo-substituted phenyl; $C_1$–$C_6$alkyl; a radical of formula —$CH_2CH_2OCH_2CH_2OH$; or 1-amino-2-sulfoanthraquinon-4-yl. Most preferably $T_1$ is hydrogen; phenyl or sulfo-substituted phenyl; or a radical of formula —$CH_2CH_2OCH_2CH_2OH$.

It is very particularly preferred to use for the process of this invention at least one of the reactive dyes of formulae (6) to (23)

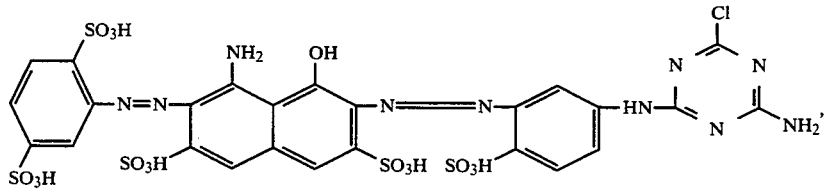

(6)

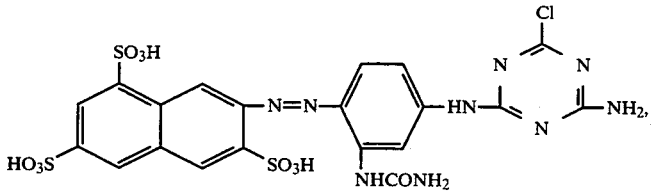

(7)

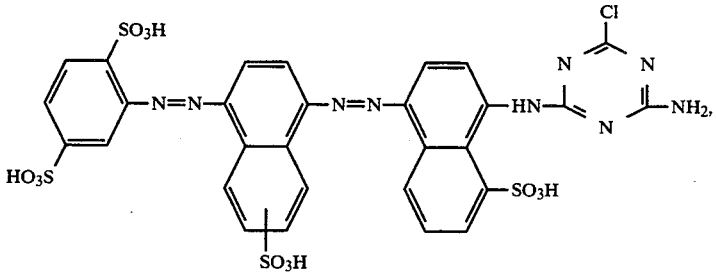

(8)

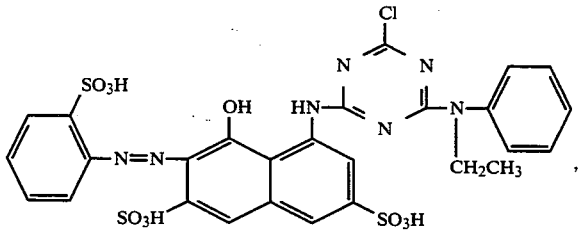

(9)

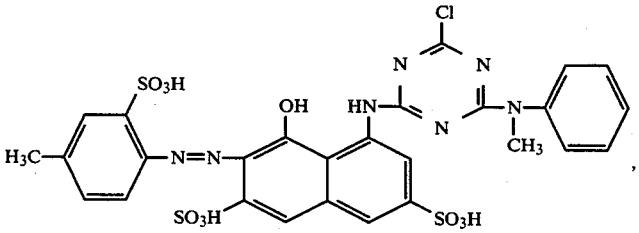

(10)

-continued
(11)
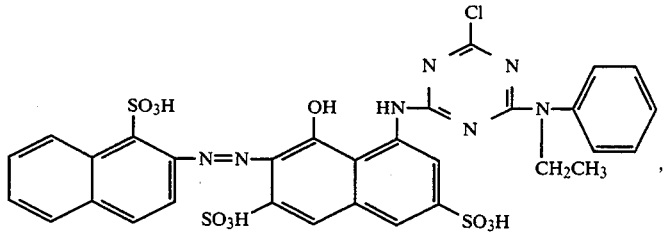
(12)
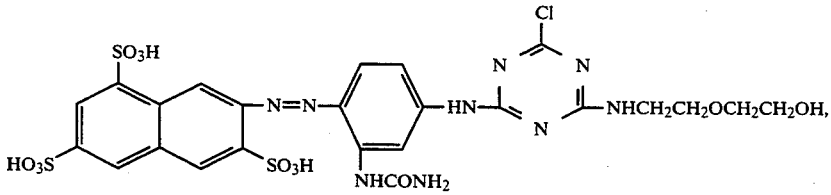
(13)
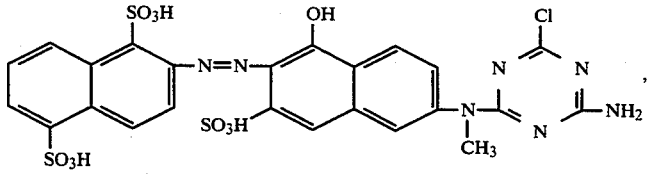
(14)
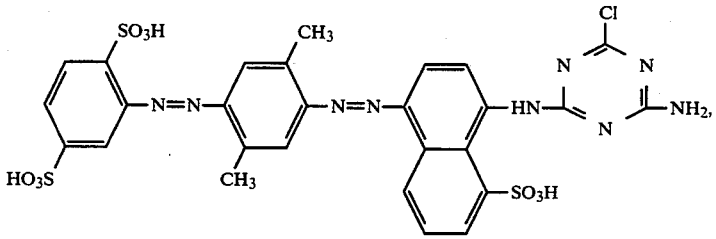
(15)
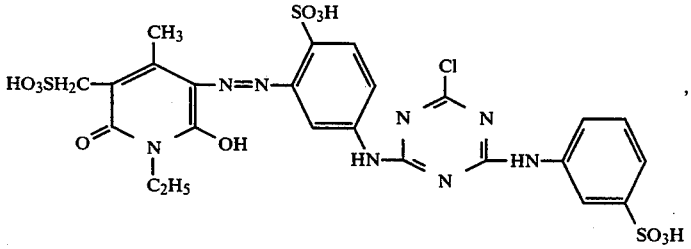
(16)
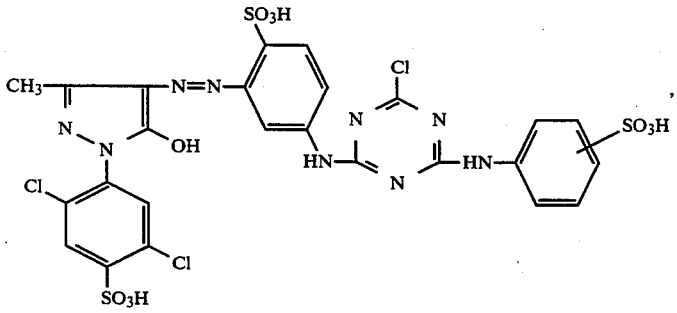
(17)
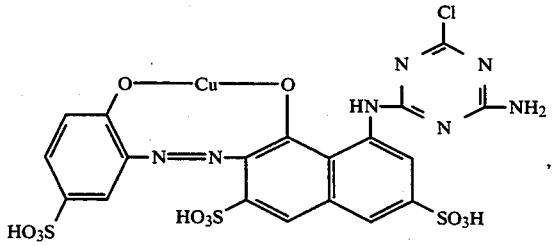

-continued
(18)
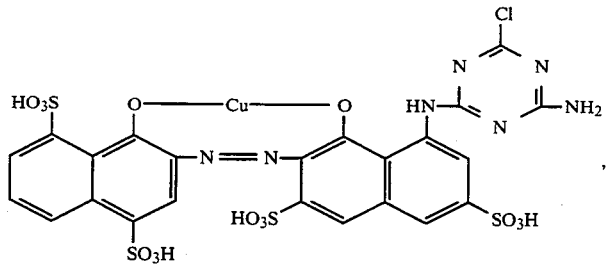
(19)
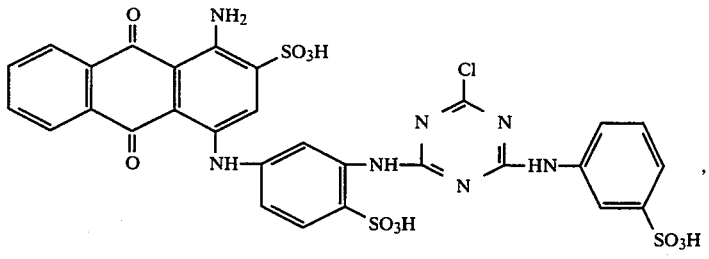
(20)
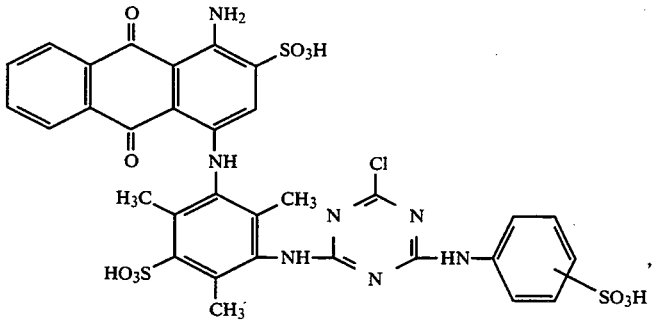
(21)
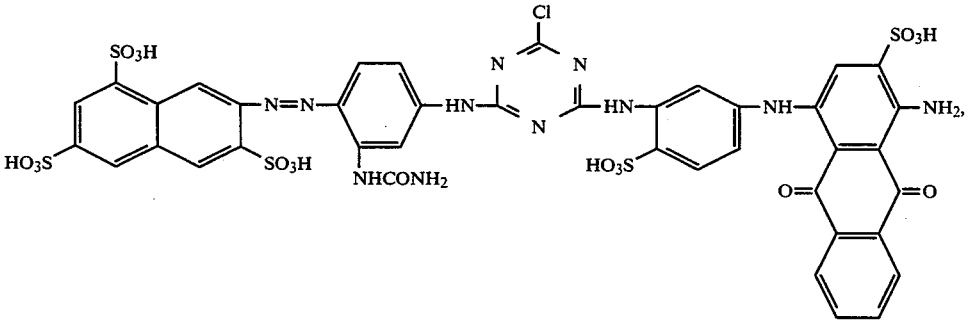
(22)
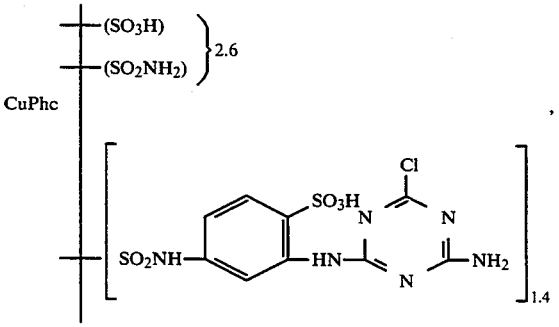

-continued (23)

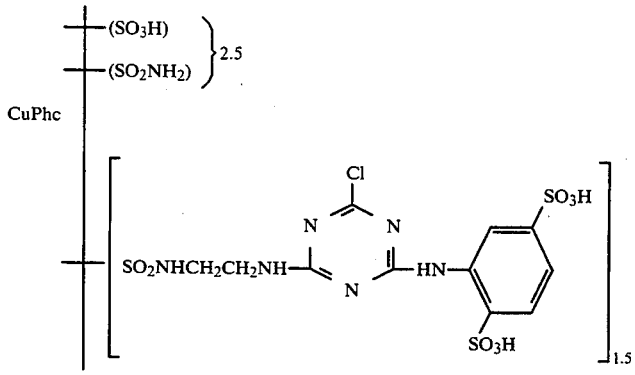

As alkaline earth metal salts it is preferred to use magnesium, calcium or barium salts, more particularly magnesium or calcium salts. It is also possible to use mixtures of alkaline earth metal salts, conveniently mixtures of magnesium and calcium salts. Customary salts such as the corresponding halides, typically fluorides, bromides or, preferably, chlorides, or sulfates or oxides, may suitably be used.

It has been found that the upper limit for the addition of the alkaline earth metal salts is advantageously 1 gram per liter, preferably 0.2 gram per liter. The preferred lower limit for the addition of the alkaline earth metal salts is 0.05 gram per liter. It is particularly preferred to add 0.01 to 1 gram per liter, more particularly 0.01 to 0.2 gram per liter, preferably 0.05 to 0.2 gram per liter, of alkaline earth metal salts.

The standard dyeing or printing methods may be used for the process of this invention. In addition to containing water and the dyes, the dye liquors or print pastes may contain further ingredients such as wetting agents, antifoams, levelling agents, or textile conditioning agents such as fabric softeners, flame retardants, dirt, water and oil repellants, as well as water softeners and natural or synthetic thickeners, typically alginates and cellulose ethers.

The preferred utility of the process is for printing.

A particularly preferred embodiment of the printing process comprises, in a first step, washing the printed fibre material with water that contains an insubstantial amount of alkaline earth metal salts and then, in a second step, with an aqueous solution to which at least 0.01 gram per liter of alkaline earth metal salts has been added. With respect to the amounts of alkaline earth metal salts, the preferences stated above apply. An insubstantial amount of alkaline earth metal salts will be understood as meaning in this context a content of less than 0.01 gram per liter, typically of less than 0.005 gram per liter and, preferably, of less than 0.001 gram per liter.

A particularly preferred embodiment of the printing process comprises, in a first step, washing the printed fibre material with cold water that contains an insubstantial amount of alkaline earth metal salts and then, in a second step, with an aqueous solution to which at least 0.01 gram per liter of alkaline earth metal salts has been added, initially hot (e.g. in the temperature range from 80° to 110° C.) and then cold (e.g. in the temperature range from 5° to 40° C.).

Besides single dyes, mixtures of two or more dyes may also be used.

It is preferred to use at least one dye of formulae (6) to (8).

The dyes used in the process of this invention are known or can be prepared by known processes.

Cellulosic fibre materials are typically natural cellulose fibres such as cotton, linen and hemp, as well as rayon and regenerated cellulose. Other suitable cellulosic fibre materials are components of fibre blends, tyically blends of cotton with polyester or polyamide fibres.

The dyeings and prints obtained by the process of the invention have superior tinctorial strength and excellent stability of the dye/fibre bond, in addition good lightfastness and very good wetfastness properties such as fastness to washing, water, sea-water, cross-dyeing and persipiration, as well as good fastness to pleating, ironing and rubbing.

To be singled out for special mention are the good wetfastness properties, which are enhanced by the inventive process.

The following Examples will serve to illustrate the invention. Unless otherwise stated, parts and percentages are by weight. The relationship between parts by weight and parts by volume is the same as that between the kilogram and the liter.

Example 1

A print paste of the following composition is prepared:

30 g of the reactive dye of formula (6)

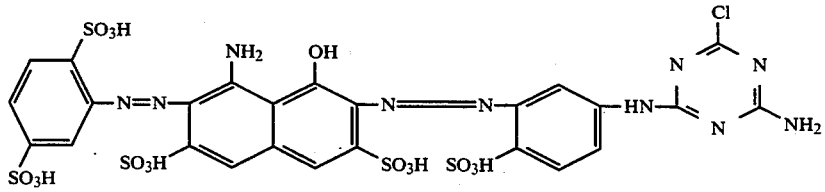

and 100 g of urea are dissolved in 350 g of water and homogenised with 450 g of a 5% sodium alginate thickener.

Using an impeller, 60 g of an aqueous solution of sodium carbonate (25%) are added and 10 g of sodium o-nitrobenzene sulfonate are strewn in.

Cotton fabric is printed with this print paste in conventional manner (flat screen printing). The printed cotton fabric is dried and steamed for 10 minutes at c. 100° C. in saturated steam.

The printed fabric is afterwards washed cold and then at the boil with deionised water, and subsequently washed cold, at the boil and then cold again with an aqueous solution that contains 0.09 g/l of calcium chloride.

After drying, a navy blue print of good wetfastness properties is obtained.

Examples 2 to 18

The procedure of Example 1 is repeated, but replacing the reactive dye of formula (6) with one of the reactive dyes of formulae(7) to (23), to give prints of good wetfastness properties.

What is claimed is:

1. A process for aftertreating a cellulosic fiber material which is printed with at least one reactive dye that contains a chlorotriazinyl radical, which process comprises washing the printed cellulosic fiber material with an aqueous solution to which 0.01 to 1 gram per liter of an alkaline earth metal salt has been added.

2. A process according to claim 1, wherein the reactive dye is of formulae (6) to (23)

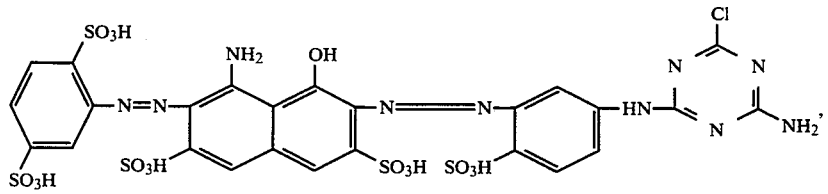

(6)

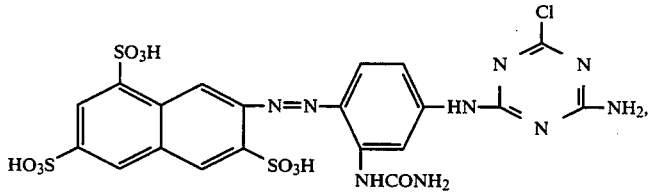

(7)

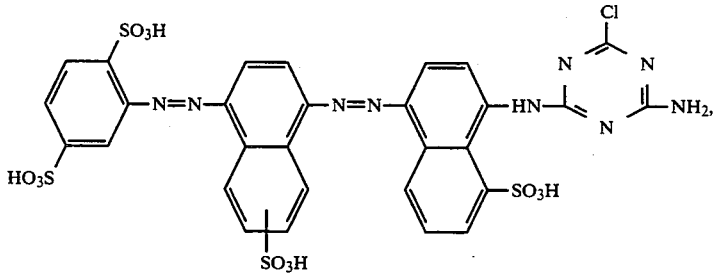

(8)

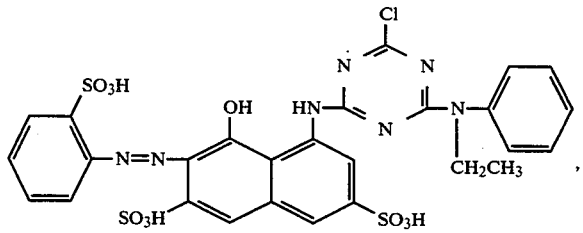

(9)

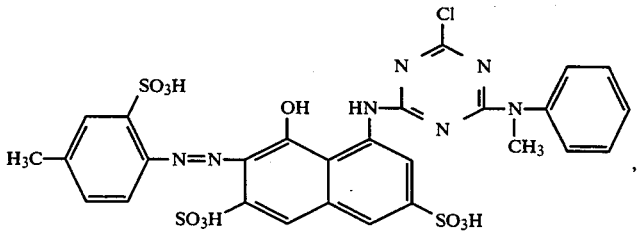

(10)

-continued
(11)
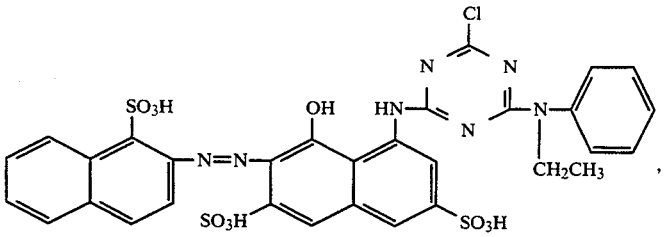
(12)
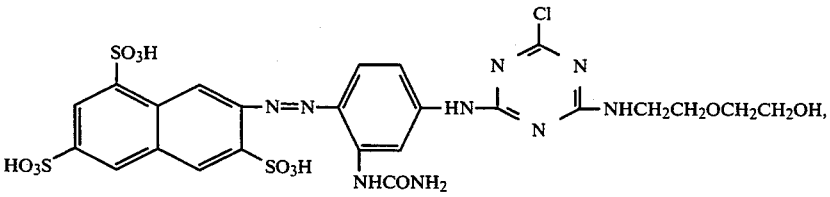
(13)
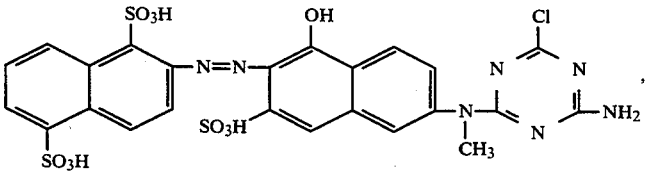
(14)
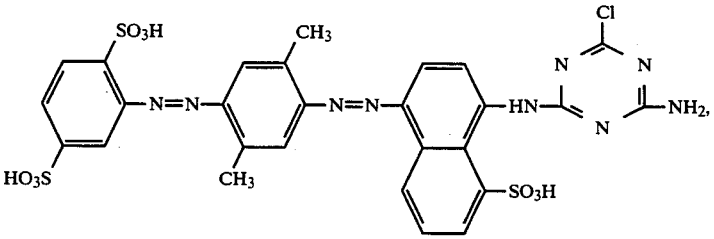
(15)
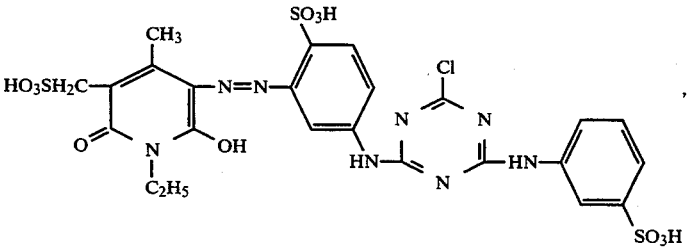
(16)
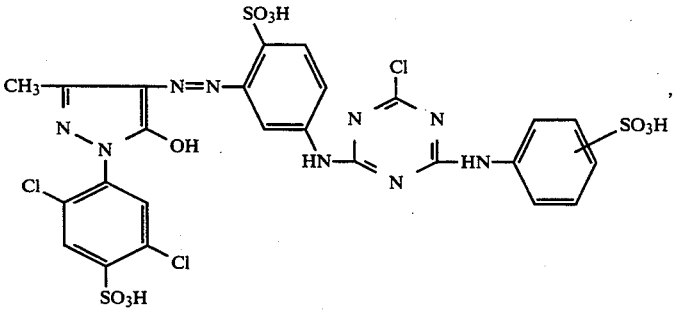
(17)
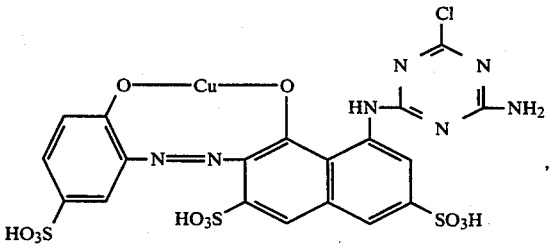

-continued
(18)
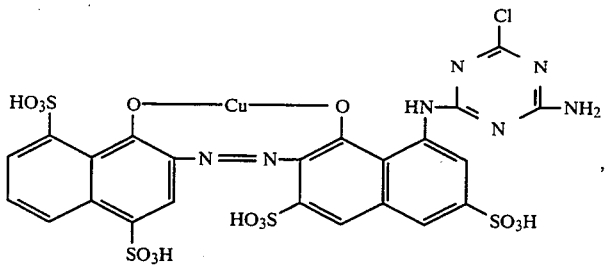
(19)
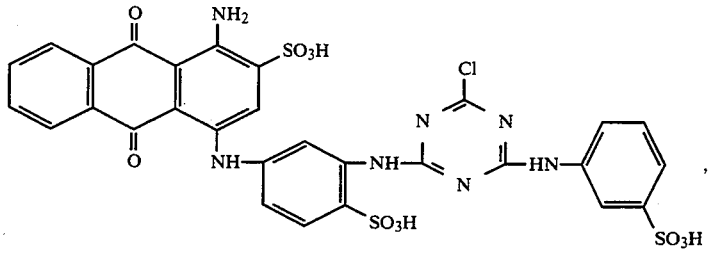
(20)
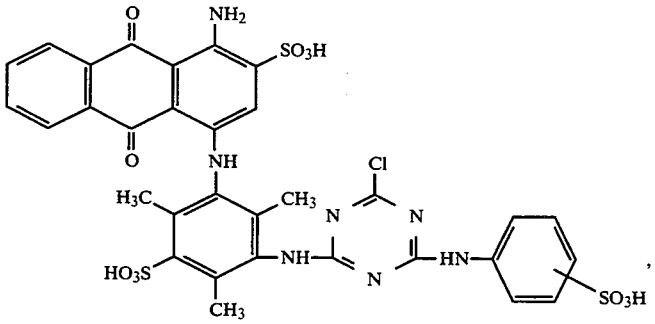
(21)
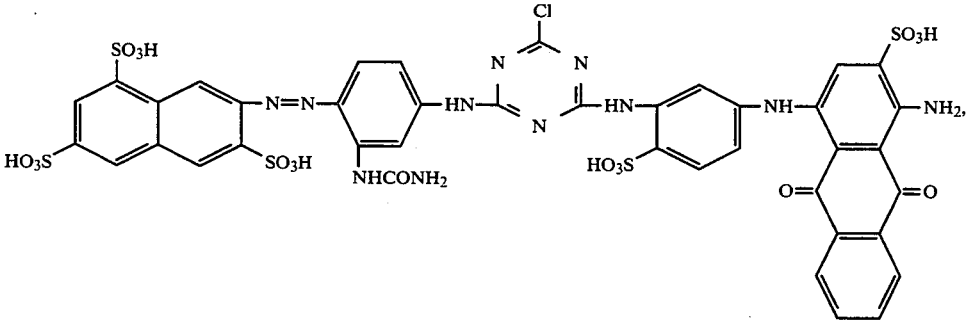
(22)
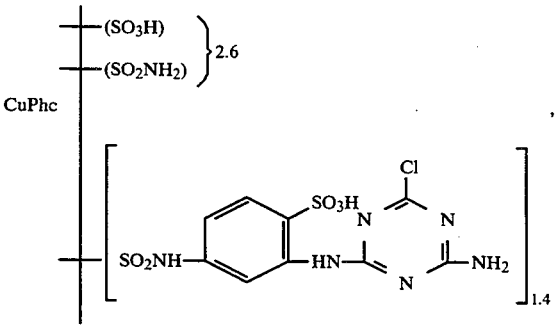

-continued (23)

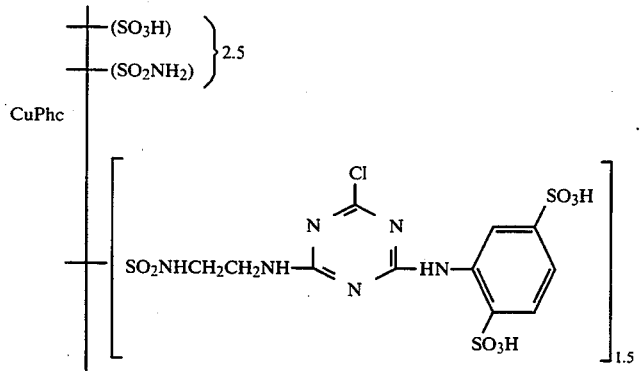

3. A process according to claim 1, which comprises washing the printed fibre material in a first step with water that contains an insubstantial amount of alkaline earth metal salt, and then in a second step with an aqueous solution to which at least 0.01 gram per liter of an alkaline earth metal salt.

4. A process according to claim 1, which comprises washing the printed cellulosic fibre material with an aqueous solution to which 0.01 to 0.2 gram per liter of an alkaline earth metal salt has been added.

5. A process according to claim 1, which comprises washing the printed cellulosic fibre material with an aqueous solution to which 0.05 to 0.2 gram per liter of an alkaline earth metal salt has been added.

6. A process according to claim 1, wherein the alkaline earth metal salt is a magnesium or calcium salt.

7. A process according to claim 2, wherein the reactive dye is of formulae (6) to (8).

* * * * *